United States Patent [19]
Nelson

[11] 4,012,035
[45] Mar. 15, 1977

[54] SORTER CONTROL SYSTEM

[75] Inventor: John A. Nelson, Pittsford, N.Y.

[73] Assignee: Xerox Corporation, Stamford, Conn.

[22] Filed: Sept. 25, 1975

[21] Appl. No.: 616,797

[52] U.S. Cl. ..... 271/173
[51] Int. Cl.² ..... B65H 29/58
[58] Field of Search ..... 271/173, 64; 270/58

[56] References Cited

UNITED STATES PATENTS 3,467,371 9/1969 Britt et al. ..... 270/58
3,618,936 11/1971 Ziehm ..... 271/173

*Primary Examiner*—Johnny D. Cherry
*Assistant Examiner*—Bruce H. Stoner, Jr.

[57] ABSTRACT

An improved sorter control system for controlling modular sorting assemblies which receive copy sheets from a duplicating machine and distribute the sheets into bins to form collated sets of document information being reproduced. The control system uses two cam operated switches in conjunction with two contacts of a relay which change state as a sheet of paper interrupts a light beam in each of the modular sorter assemblies. In this manner both the lead edge and the trail edge of a copy sheet break the light beam upon entering a bin causing an index mechanism which controls the sequence of opening the gates for each of the bins to advance. The gate last opened directs copy sheets to the next modular sorting assembly to continue the sorting operation in an expeditious manner.

2 Claims, 6 Drawing Figures

FIG. 3
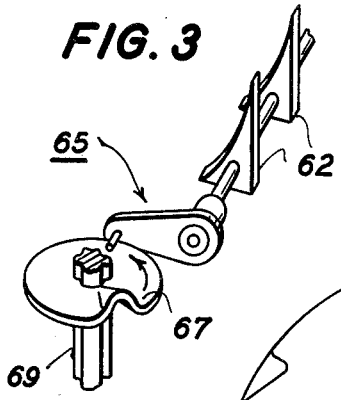
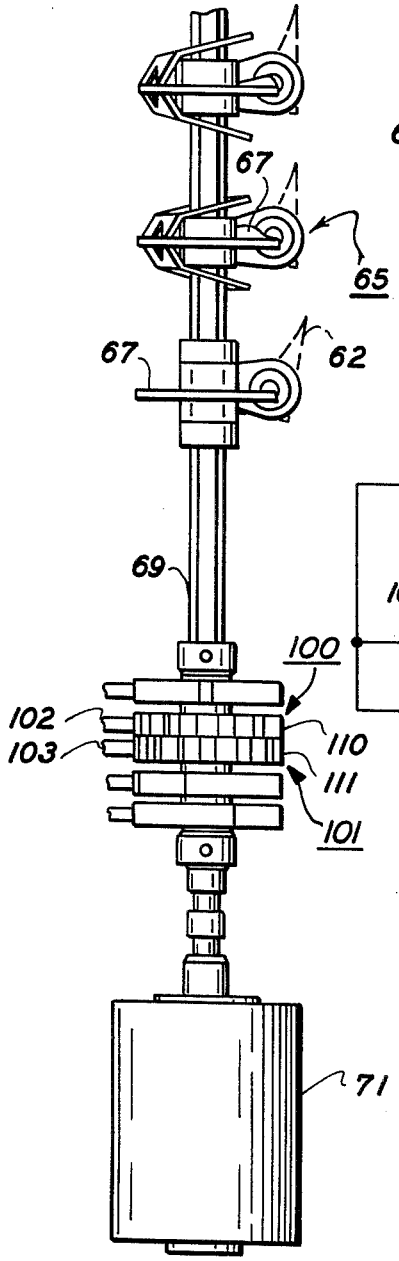
FIG. 2
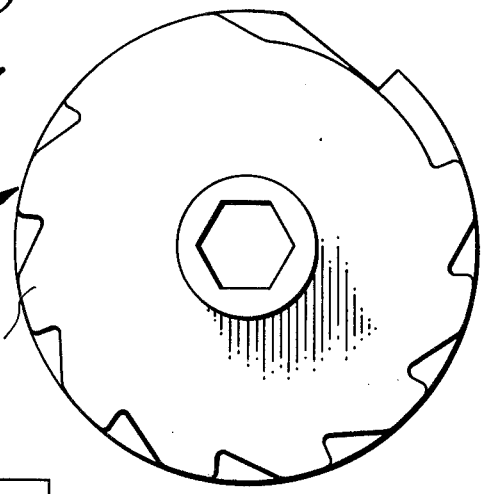
FIG. 4
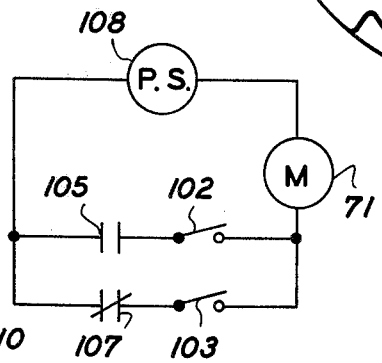
FIG. 6
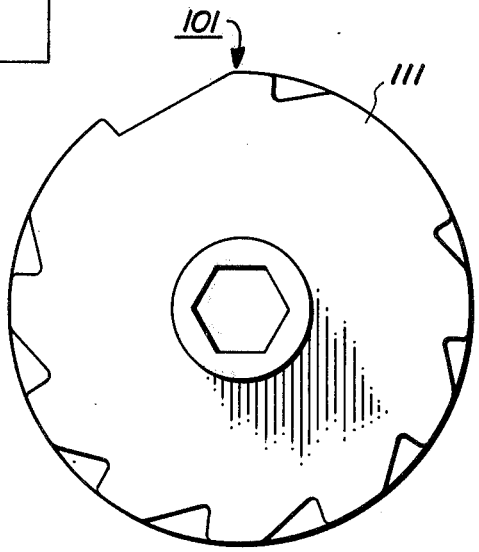
FIG. 5

SORTER CONTROL SYSTEM

This invention relates in general to copier/duplicator machines and in particular to an improved control system for modular sorting assemblies which distribute copy sheets in collated sets of document information produced on the copier/duplicator machine. The instant application incorporates by reference U.S. Pat. Nos. 3,567,214 issued on Mar. 2, 1971 and 3,467,371 issued on Sept. 16, 1969 describing document feeding and sheet sorting apparatus, respectively, and commonly assigned herewith.

Since the advent of the basic xerographic process as disclosed in U.S. Pat. No. 2,297,691 to Carlson a variety of machines for copying and duplicating have been placed in commercial use. Many of the duplicator machines have modular sorting assemblies for distributing copy sheets into trays or bins in collated sets as described, for example, in the above patent and U.S. Pat. Nos. 3,460,824 and 3,774,906. Usually the entry of the sheets into each of the trays is controlled by a gate mechanism which deflects the sheets into the trays in sequence from a sheet path along a transport.

In the past there has been a problem in the sense that it was necessary to remember whether the lead edge or trail edge of the sheet was blocking the light beam and it was required that there be complete entry of the copy sheet into the tray before the next action could be initiated. As a result the circuitry was complex. Also it was essential that the spacing between sheets be separated by a minimum distance which was equal to the distance between the upper and lower trays of each modular sorting assembly because the next to last gate had to function before the last gate directing sheets into the next modular sorter assembly could function.

In accordance with the present invention a new and improved indexing mechanism and control system is provided which does not require a memory to determine whether the trail or leading edge of the copy sheet is passing through a light sensing device. Nor does the instant invention require that a minimum spacing between copy sheets be equal to the distance between the upper and lower trays of a modular sorting assembly. As a result, the required speed of the paper movement in a particular modular sorter assembly and the operation of advancing from one modular sorter assembly to the next is considerably reduced with a greater reliability of operation.

It is therefore an object of this invention to improve copier/duplicator systems.

It is a further object of this invention to improve copier/duplicator systems in which document information is produced in collated sets in modular sorter assemblies.

It is another object of this invention to distribute copy sheets to a plurality of modular sorter assemblies with improved control and reduced required transport speed.

It is a further object of the present invention to improve the handling of copy sheets by a plurality of modular sorter assemblies which are used to distribute copy sheets in collated sets of document information produced by a copier/duplicator machine.

For a better understanding of the invention as well as other objects and further features thereof, reference is had to the following detailed description of the invention which is to be read in conjunction with the accompanying drawings.

FIG. 2 is an enlarged view of the indexing mechanism for activating the diverting gates of a modular sorter assembly;

FIG. 3 is an enlarged perspective view of an actuator for actuating a set of gate members:

FIG. 4 is an enlarged view of the cam of the indexing mechanism;

FIG. 5 is an enlarged view of a second cam of the indexing mechanism;

FIG. 6 is a schematic view of the electrical circuit of the control system according to the present invention.

Figure 1:
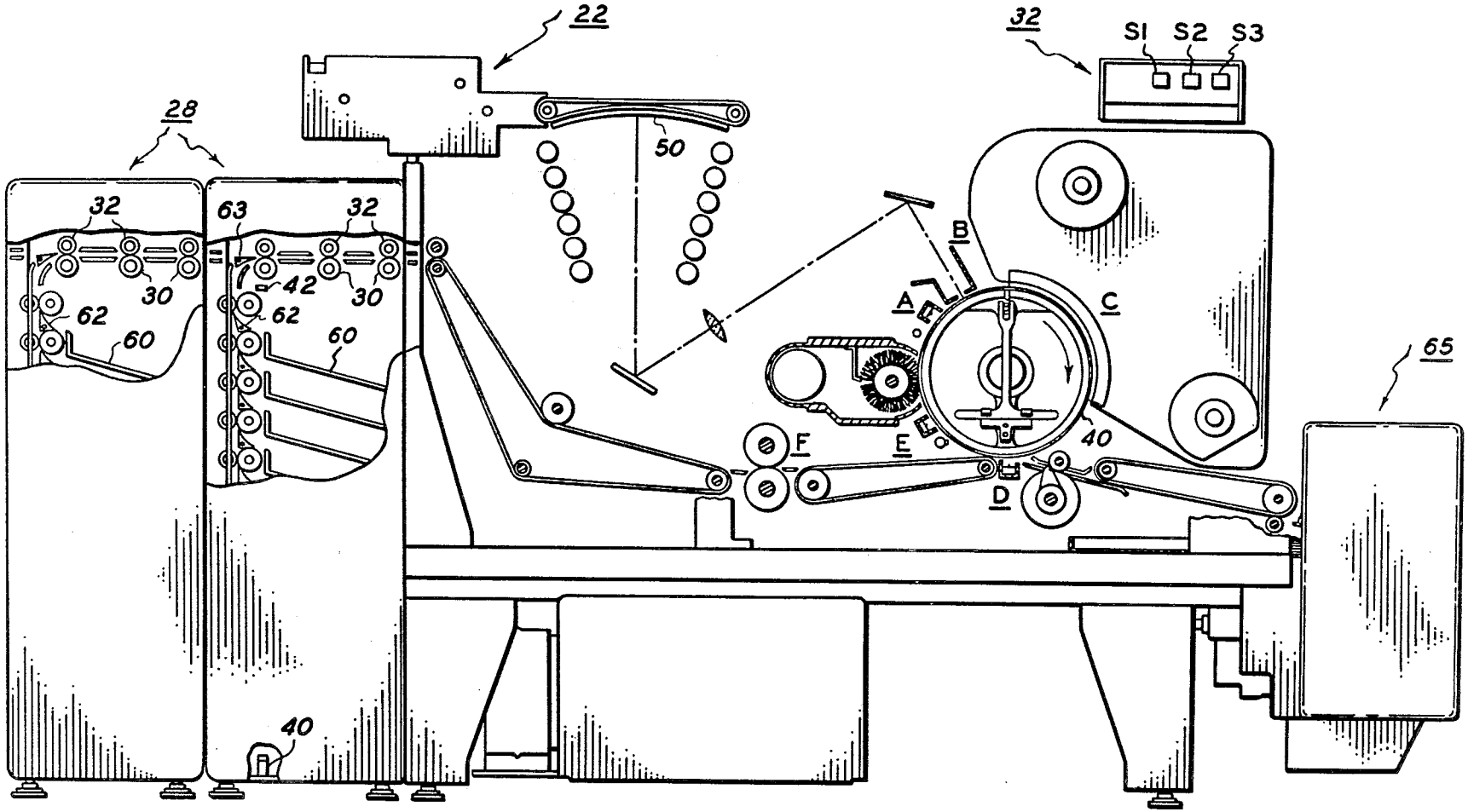
FIG. 1 illustrates schmatically an electrostatographic reproducing machine including a document feeder and a plurality of modular sorter assemblies operated and controlled in accordance with the instant invention.

In FIG. 1 is shown an electrostatographic reproducing machine which comprises a document feeding apparatus 22 positioned on a xerographic processor 25 which transports copy sheets to a plurality of modular sorting assemblies 28. A control panel 32 includes the usual counters and buttons including a switch S1 for start print, a switch S2 for sorting on and a switch S3 for document feeder on. The processor includes a drum shaped member 40 including a photoconductive layer or light receiving surface on a conductive backing. The drum member is mounted on a shaft journaled in frame to rotate in the direction of the arrow to cause the drum surface to pass sequentially a plurality of xerographic processing stations.

For the purpose of the present disclosure the processing stations in the path of movement of the drum surface may be described functionally as follows:

A charging station A at which a uniform electrostatic change is deposited on the photoconductive layer of the drum;

An exposure station B at which a light of radiation or pattern is projected onto the drum surface to thereby dissipate the drum charge in the exposed areas thereby forming a latent electrostatic image of the copy to be reproduced;

A developing station C at which a xerographic developing material including toner particles having an electrostatic charge opposite to that of the electrostatic latent image are cascaded over the drum surface whereby the toner particles adhere to the latent electrostatic image to produce a xerographic powder image in a configuration of the copy being reproduced;

A transfer station D at which the powder image is electrostatically transferred from the drum surface to copy sheet made of paper material;

A drum cleaning and discharge station E at which the drum surface is cleaned to remove residual toner particles thereon after image transfer and at which the drum surface is exposed so a relatively bright light source to effect substantially complete discharge of any residual electrostatic charge remaining thereon; and A fusing station at which the powder image is permanently affixed to the copy sheet which is paper and which is transported to a plurality of modular sorter assemblies 28 for producing collated sets of the document information.

For a more detailed description of the processor reference is made to U.S. Pat. No. 3,301,126 to Osborne et al which is commonly assigned herewith.

It should be understood that the copier/duplicator machine can utilize a document feeding apparatus 22 as described in the above mentioned patent which feeds documents onto the platen 50 of the processor, or, alternatively, the documents may be handled manually by a machine operator. Copy sheets produced by the processor are distributed to the modular sorter assemblies 28 by drive rolls 30 with cooperating idler rolls 32 to move the sheets past the inlets of bins 60. A light source 40 and a photodetector 42 are located in each of the sorting assemblies to detect the presence of copy sheets entering the bins. The sheets are diverted into the appropriate bin in sequence beginning with the top bin and proceding towards the bottom bin by gate members 62. The structure of the drive rolls and gate members in their operation is described more fully in the above U.S. Pat. No. 3,467,371 issued Sept. 16, 1969 and commonly assigned with the instant application.

In accordance with the present invention both the lead edge and a trail edge of the copy sheets serve to advance the index mechanism for actuating the gate members in each of the modular sorter assemblies 28. In the prior art devices, only the trail edge was used to advance the indexing mechanism which operated the gate members in their sequence. This type of operation required that the logic store the arrival of the lead edge of the copy sheet in order that it would be recognize the trail edge when it appeared. The disadvantage of the prior art devices is that it required a more complex circuitry which was less reliable than that of the instant invention. Another disadvantage of the prior art system is that it required complete entry of the copy sheet into a tray before the next action could be initiated in the control logic. As a result, the copy sheets had to be separated by a minimum distance equal to that at least between the uppermost and lowermost bin which delayed the sorting operation unnecessarily.

Referring now to FIGS. 2 – 6 of a set of gate members 62 for each of the bins is moved to an open position by a cam follower 65 which is actuated by a cam 67 rotated by a shaft member 69. Shaft member 69 is rotated by a motor 71. The angular rotation of shaft member 69 is dependent on cam switches which are actuated by cams fixed to the shaft member, as will be described more fully hereinafter. It will be noted that there is one set of gate members for each bin and also an additional set of gate members 63 located at the top of each modular sorter assembly which is used to direct the copy sheet to the next modular sorting assembly. It will be further appreciated that the lowermost set of gate members 62 is fixed in the open position and therefore does not have to be actuated.

In accordance with the invention cam members 100 and 101 are fixed to a shaft member 69 for rotation therewith. The two cam members 100 and 101 each include a plurality of cam indentations 110 and 111 respectively, for each of the gate members which are actuated. Cam members 100 and 101 operate switches 102 and 103 respectively. The two switches 102 and 103 act in conjunction with the two states of a relay (not shown) having relay contacts 105 and 107 (FIG. 6) which complete the circuit to a power supply 108 for energizing motor 71. It will be appreciated that in lieu of a relay and switch that a photodetector with solid state logic and driver can be used.

In operation, starting at gate 1 the switch 102 is open and switch 103 is closed and the light path of light source 40 is clear. The relay is energized and contact 105 is open. The circuit to the motor 71 is also open. As a copy sheet starts to enter the first bin the light beam is interrupted thereby. As a result the relay is deenergized closing contact 107, the circuit to the motor. The motor turns the cams 100 and 101 until switch 103 opens. At this time the circuit is open and the motor stops. External linkages are such that this movement does not change the state of this set of gate members or any other related operation. Switch 102 is closed by the rotation of cam 100 but this causes nothing to happen at this time because contact 105 is open. As the copy sheet clears the light beam the relay is energized and the circuit to the motor is completed through the switch 102 which was closed at the immediate previous cam rotation. The motor then advances until switches 102 opens at the next cam indentation. The external linkages are such that the first set of gate members close and the second set of gate members open. This operation continues for each set of the gate members until all of the gate members to each of the associated bins have been opened in sequence. The eleventh set of gate members is opened last which directs the copy sheets into the next modular sorting assembly. Since the lowermost set of gate members in the modular sorting assembly is fixed open, it is not necessary to change its state. The cams dwell for switch 102 at the lower most set of gate members is extended so that switch 103 does not open until the motor has advanced far enough to operate the topmost set of gate members. In this manner the leading edge of the tenth sheet causes the set of gate members to be prepared for the eleventh sheet. This reduces the minimum distance between the trailing edge of the tenth sheet and leading edge of the eleventh sheet.

Above is described control system for modular sorter assemblies in which the indexing mechanism for controlling gates for admitting copy sheets into sorting bins is improved by increased speed in sheet handling while improving reliability.

While the invention has been described with reference to the structure disclosed, it is not confined to the details set forth, but is intended to cover such modifications or changes as may come within the scope of the following claims.

What is claimed is:

1. An improved control system for modular sorter assemblies which distribute copy sheets into bins in collated sets from a document information reproduced by a copier/duplicator machine comprising:

a plurality of modular sorter assemblies operative to receive copy sheets sequentially, an array of sorting bins in each assembly to receive copy sheets in collated sets, gate members associated with each of the bins to deflect copy sheets thereinto from a sheet path, gating means operative to control the distribution of copy sheets into the next modular sorter assembly after sorting is completed in the bins in a paricular assembly, first and second cam members associated with each sorting assembly, each cam member having a plurality of cam indentations with each indentation corresponding to an associated gate member or gating means, said indentations on said first cam member being offset from indentations on said second cam member, said cam members being arranged for controlling the opening and closing of said gate members and gating means in a predetermined sequence, drive means for rotating said cam members and actuating said gate members and gating means, circuit means including a photodetector means operating two contacts which are opened and closed as sheet presence and absence is detected at the bins' entrance and switching means for energizing said drive means to move said cam members and to actuate said gate members and said gating means in proper sequence in response to the presence and absence of copy sheets at the entrance of the bins, wherein said switching means includes two single pole single throw switches, each switch being operated by an associated cam member when said cam member is rotated, wherein the movement of the cam members occurs for both the presence and absence of sheets at the bins' entrances.

2. A system according to claim 1 wherein the gate members associated with the last bin to receive sheets are locked in the opened position and the dwell of the indentation corresponding to the last bin is extended so that there is sufficient rotation of said cam members on the lead edge of the sheets entering the last bin to operate said gating means as aforementioned.

* * * * *